United States Patent [19]

Jaggle et al.

[11] Patent Number: 4,666,087

[45] Date of Patent: May 19, 1987

[54] ELECTROMAGNETICALLY ACTUATABLE VALVE

[75] Inventors: Gunther Jaggle, Stuttgart; Hans Kubach, Korntal; Werner Paschke, Schwieberdingen, all of Fed. Rep. of Germany

[73] Assignee: Robert Bosch GmbH, Stuttgart, Fed. Rep. of Germany

[21] Appl. No.: 831,123

[22] Filed: Feb. 21, 1986

Related U.S. Application Data

[63] Continuation of Ser. No. 628,003, Jul. 5, 1984, abandoned.

[30] Foreign Application Priority Data

Aug. 6, 1983 [DE] Fed. Rep. of Germany ..... 3328467

[51] Int. Cl.[4] ..... B05B 1/32

[52] U.S. Cl. ..... 239/451; 239/585

[58] Field of Search ..... 251/129.1, 129.15, 129.18, 251/129.2, 129.22; 239/541, 451–454, 585, 533.7, 437

[56] References Cited

U.S. PATENT DOCUMENTS

| | | | |
|---|---|---|---|
| 1,151,089 | 1/1914 | Dietsch | 239/454 |
| 1,845,618 | 2/1932 | Miller | 239/454 |
| 2,749,181 | 6/1956 | Maxwell et al. | 239/533.7 X |
| 3,008,653 | 11/1961 | Morris et al. | 239/453 |
| 3,347,470 | 5/1963 | Svoboda | 239/453 |
| 3,450,353 | 6/1969 | Eckert | 239/585 |
| 3,731,880 | 5/1973 | Williams | 239/585 |
| 3,735,927 | 5/1973 | Monpetit et al. | 239/585 |
| 4,331,294 | 5/1982 | Gilad | 239/454 X |
| 4,344,449 | 8/1982 | Meyer | 239/585 X |
| 4,421,280 | 12/1983 | Lewis et al. | 239/585 |
| 4,437,611 | 3/1984 | Gilroy | 239/453 |
| 4,470,545 | 9/1984 | Deckard et al. | 239/585 X |

FOREIGN PATENT DOCUMENTS

| | | | |
|---|---|---|---|
| 2926217 | 1/1981 | Fed. Rep. of Germany | 239/453 |
| 852264 | 2/1979 | U.S.S.R. | 239/453 |

*Primary Examiner*—Andres Kashnikow
*Assistant Examiner*—Kevin Patrick Weldon
*Attorney, Agent, or Firm*—Edwin E. Greigg

[57] ABSTRACT

An electromagnetically actuatable valve which serves as a fuel injection valve for fuel injection systems in internal combustion engines. The valve includes a valve housing as well as a magnetic coil with poles serving as the core, with which an armature cooperates, which is connected to a valve element the sealing element of which cooperates with a valve seat in a valve seat body. The valve element protrudes without contact through a throttle bore in the valve seat body with a throttling element and is held in a sealing manner on the valve seat by the armature when the magnetic coil is excited. When the magnetic coil is not excited, the valve element is moved by the pressure forces of the fluid in the opening direction of the valve and is centered by the fluid flow.

9 Claims, 3 Drawing Figures

ELECTROMAGNETICALLY ACTUATABLE VALVE

This is a continuation of copending application Ser. No. 628,003, filed July 5, 1984 now abandoned.

BACKGROUND OF THE INVENTION

The invention is directed to improvements in electromagnetically actuatable valves for fuel injection systems. An electromagnetically actuatable valve is already known in which an outwardly-opening valve needle is supported in a guide bore and actuated by an armature in the opening direction, counter to a valve needle spring. In this valve, not only does the friction of valve needle movement cause hysteresis errors in triggering the valve, but to actuate the valve needle the electromagnet also needs a high triggering output to overcome the force of the valve needle spring and must accordingly be larger in size. Furthermore the valve needle is always carried by the valve needle spring such that it makes contact on one side with the guide bore resulting in a non-uniform fuel stream emerging from the fuel injection valve, thus causing poorer fuel preparation and a lack of uniform mixture distribution to the individual cylinders of the internal combustion engine.

OBJECT AND SUMMARY OF THE INVENTION

The electromagnetically actuatable valve according to the invention has the advantage over the prior art that it does not have a spring to undesirably affect the position of the valve element and the triggering output. An object of the invention is that a radial centering of the valve element can be effected with the least possible movement friction, so that a smaller armature mass and a lower triggering output are required, resulting in very good preparation of the ejected fuel and a long, trouble-free service life of the valve.

Another object of the invention is to reinforce the radial centering of the armature and the valve element by providing the opposing faces of the poles and the armature with spherical surfaces adapted respectively as concave and as convex, so that the valve element is stable in the vertical position when the armature is resting on the poles.

It is a further object of the invention that the valve element protrude through the valve seat body without contacting it and that it be capable of being centered by the fluid when the sealing element is raised from the valve seat.

It is a still further object of the invention to provide an inclined stop face on the armature, which cooperates with a conical stop bore in the valve seat bore in centering the armature and the valve element radially.

It is yet another object of the invention to provide a narrow guide section on the armature that cooperates in a snug fit with the flow bore, by means of which the armature and valve element are radially centerable.

It is yet a still further object of the invention to improve the adjusting of the partial valve stroke with respect to the valve seat by providing the armature and the valve element as axially movable relative to one another or as elastically deformable.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
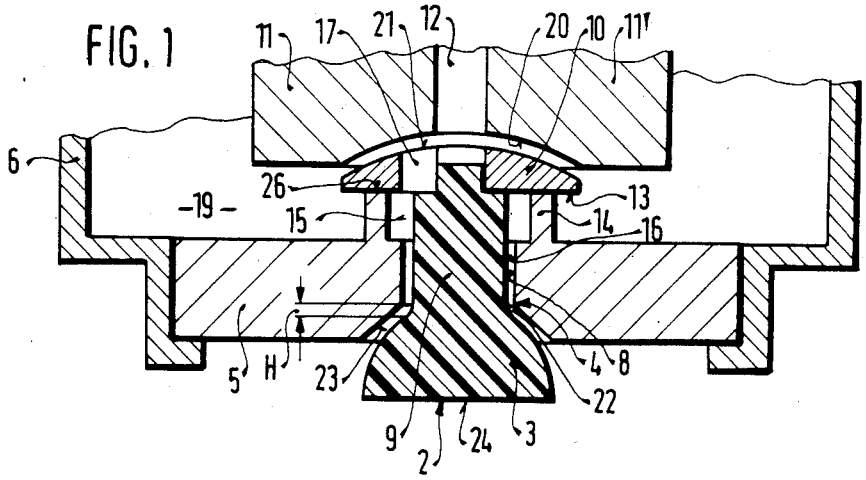
FIG. 1 is a cross-section of a first exemplary embodiment of an electromagnetically actuatable valve according to the invention.

The fuel injection valve shown in a cross-sectional view of FIG. 1 is actuatable electromagnetically in a known manner by the exciting of a magnetic coil, not shown, and serves for example as part of a fuel injection system to inject fuel, in particular at low pressure, into the air intake tube of mixture-compressing internal combustion engines with externally supplied ignition. The fuel injection valve has a movable valve element 2, which may comprise a non-magnetic material such as brass, austenite steel or like material and has a sealing element 3 which cooperates with a valve seat 4 in a valve seat body 5 of a non-magnetic material. The valve seat body 5 is inserted into a valve housing 6. Upstream of the valve seat 4, a flow bore 8 is provided in the valve seat body 5, and a connecting element 9 of the valve element 2 protrudes through this flow bore 8. Remote from the sealing element 3, the connecting element 9 of the valve element 2 is firmly connected with a disk-shaped armature 10 comprised of soft-magnetic material.

The magnetic circuit is formed by poles 11 and 11' serving as the core, and by the armature 10. The magnetic flux effected by the magnetic coil acts via the poles 11, 11'. Between the poles 11 and 11', a central opening 12 is provided, by way of which fuel from a fuel supply source, not shown and being for example a fuel feed pump, can flow into the interior of the fuel injection valve. During fuel feeding and with the magnetic coil not excited, the armature 10 and thus the valve element 2, because of the hydraulic pressure forces engaging the armature and valve element, are moved away from the poles 11, 11', and the armature 10 comes to rest, on a stop face 13 remote from the poles 11, 11', on a raised annular stop 14 provided on the valve seat body 5.

Between the annular stop 14 and the circumference of the connecting element 9, an annular cross-section 15 is formed, which discharges into the annular flow cross-section 16 formed between the flow bore 8 and the connecting element 9. This annular cross section 16 may, for example, serve as a throttling and hence a metering cross-section. Discharging into the annular cross section 15 in a preferably axially extending fashion is at least one flow opening 17, which pierces the armature 10 and communicates on the other end with the interior 19 of the fuel injection valve or with the central opening 12 between the poles 11, 11'. The armature 10 and the poles 11, 11' are oriented toward one another, preferably with spherical surfaces complementary to one another. For example, the poles 11, 11' may have a concave surface 20 extending across both poles 11, 11' and the armature 10 may have a convex surface 21 oriented toward the surface 20 of the poles 11, 11'. As a result of these matched surfaces 20, 21, a radial centering of the armature 10 with respect to the valve seat 4 is effected because of the magnetic forces.

When the magnetic coil is not excited, the armature 10 and valve element 2 are moved away from the poles 11, 11' because of the pressure exerted by the flowing fuel, so that the sealing element 3, rising from the valve seat 4, opens outward, and fuel can flow from the central opening 12 or from the interior 19 via the flow openings 17 to the annular cross-section 15 and from there via the flow cross-section 16 and the valve seat 4. As a result of the radial hydraulic forces engaging the connecting element 9 in the flow cross section 16, a radial centering of the valve element 2 is effected, so that the valve element is guided in the flow bore 8 without touching the wall (and hence without friction) by means of the fuel flow to seat on the stop 13 in a correspondingly centered manner.

Via the valve seat 4, a fuel film of uniform thickness throughout emerges and flows outwardly into an annular gap 22 formed between the surface of the sealing element 3 and an ejection opening 23. Sealing element 3 is, for example, hemispherical or otherwise spherical in shape and cooperates with the ejection opening 23, the latter provided with an increasing diameter diverging from the the valve seat 4. The fuel film flows outwardly from the valve body 5 to mix with the ambient air, which mixture emerges in a conically shaped film and tears off upon reaching the sharp-edged end face 24 of the sealing element 3, the mixture occurring on a first-in, first-out basis. The partial valve stroke H of the valve element relative to the valve seat 4 can be effected on the one hand by an appropriate machining of the end face 26 of the annular stop 14, by removing material from this end face or deforming it in a desired manner. On the other hand, the partial valve stroke H can also be adjusted by providing that the armature 10 and the valve element 2 are axially displaceable relative to one another. The armature 10 and the valve element 2 may be suitably soldered or welded.

Because there is no valve spring urging the valve element 2 in the closing direction and thus a lack of frictional movement at the valve element, the magnetic forces required for closing the fuel injection valve are very small, so that the armature 10 can have a small mass, and a low triggering power on the part of the magnetic coil is required. The result is a fuel injection valve that is small in size and lightweight, which operates rapidly and reliably, and is inexpensive, while it does not need guide means which wear and cause friction. The small masses of the valve element 2 and the armature 10 assure a long, trouble-free service life of the fuel injection valve, because of the slightness of pounding upon changes in movement at the valve seat 4 and the annular stop 14.

Figure 2:
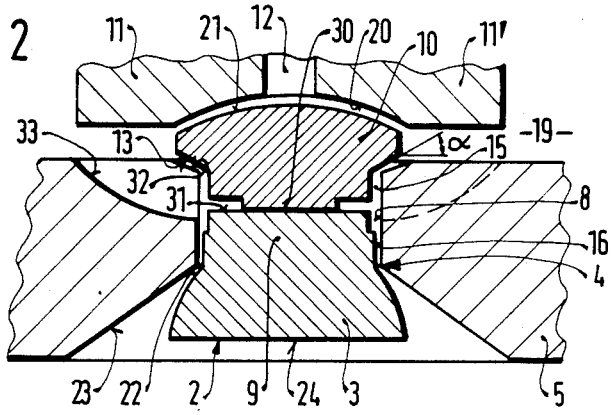
FIG. 2 is a cross-section of a second exemplary embodiment of a valve according to the invention.

In the second exemplary embodiment of a valve according to the invention, as shown in FIG. 2, elements having the same function and embodiment as those of the first embodiment are identified by the same reference numerals. As in the first exemplary embodiment of FIG. 1, the second exemplary embodiment of FIG. 2 also has a flow bore 8 in the valve seat body 5, through which bore the connecting element 9 of the valve element 2 protrudes. Between the connecting element 9 and the flow bore 8 there is again a flow cross-section 16, which can again act as a throttle and hence as a metering cross-section. Abutting the valve element 2, the armature 10 has a tang 30, which is seated in the vicinity of the annular cross-section 15 on the end 31 of the valve element 2; the tang 30 can be butt-welded or soldered to this end 31. On the armature 10, remote from the poles 11, 11', a stop face 13 is provided, inclined at an angle $\alpha$ with respect to a plane perpendicular to the longitudinal extent of the injection valve. The valve seat body 5 is provided with a conical stop bore 32, opposed to the stop face 13, which merges into the flow bore 8. The angle $\alpha$ at the stop face 13 is larger than that which would allow full stop bore contact by the stop face 32, but yet is flat enough that, on the one hand, a good stroke stop is assured, and on the other hand, in cooperation with the stop bore 32, a good centering of the armature 10 and the valve element 2 in the flow bore 8, and thus with respect to the valve seat 4, is assured. In an advantageous manner there is an angle difference between the angle $\alpha$ of the stop face 13 and the inclination of the stop bore 32, or else the stop bore 32 is rounded off toward the interior 19. Fuel conduits 33 are provided in the valve seat body 4, leading from the interior 19 to the annular cross-section 15, and from which conduits a circular-symmetrical distribution of the fuel toward the cross-section 16 is effected. The stroke balancing can be effected by means of elastic deformation at the tang 30.

Figure 3:
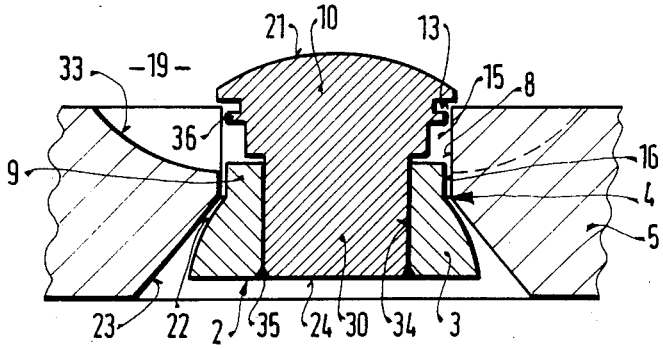
FIG. 3 is a cross-section of a third exemplary embodiment of a valve according to the invention.

In the third exemplary embodiment shown in FIG. 3, the elements that are the same and function the same as those of the foregoing embodiments are identified by the same reference numerals. Thus in the exemplary embodiment of FIG. 3 the tang 30 of the armature 10 protrudes into a securing bore 34 of the valve element 2, preferably as far as the valve element's end face 24, and is welded at the end face at 35 to the valve element 2. The valve stroke H here can be fixed in a desired manner by the suitable axial association between the armature 10 and the valve element 2. The flat stop face 13 of the armature 10 comes to rest on the valve seat body 5, when the sealing element 3 is raised from the valve seat 4. The radial centering of the armature 10 and the valve element 2 is performed in this exemplary embodiment by a narrow cylindrical guide section 36 of the armature 10, which protrudes with a narrow fit into the flow bore 8.

In the exemplary embodiments of FIGS. 2 and 3 as well, an additional radial centering can be effected by means of the fluid flowing into the flow cross sections 16, and because of the absence of a spring urging the valve element 2 in the closing direction and because of the minimal friction at the valve element, the magnetic forces required for closing the fuel injection valve are very small, so that the armature 10 can have a smaller mass, and only a low triggering output of the magnetic coil is required. As a result, a fuel injection valve is attained which is small in size and lightweight, which operates quickly and reliably, and is favorable in cost while having the least possible wear.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A magnetically actuatable valve for fuel injection systems in internal combustion engines, comprising an armature, a core associated with said armature for actuating a valve element with respect to a valve seat body provided with a fixed valve seat, said armature being formed of a soft-magnetic material, the valve element being provided with a sealing element arranged to move axially outwardly from the fixed valve seat so as to open the valve to control fuel flow from an input fuel flow line, the valve element being provided with a connecting element which permanently fixes said valve element to said armature, said connecting element having a longitudinal extent which protrudes in a non-contacting manner over its entire length through a flow bore throttling means between said armature and said fixed valve seat in the valve seat body, said flow bore throttling means being formed by an annular spacing surrounding said connecting element which functions to center said valve element as fuel flows through said throttling means, said connecting element and said valve being adapted to move from a first position during magnetic excitation in which the sealing element of the valve element is arranged so as to centrally seal the valve seat, and moved into a second position during zero magnetic excitation wherein the valve element is forced in the opening direction of the valve by fuel pressure and said connecting element is radially centered over its entire length by the fuel pressure flow in said second position.

2. A valve as defined by claim 1, further wherein the armature is provided with a stop face inclined at an angle ($\alpha$) to a cross-sectional plane therein, which stop face cooperates radially to center the armature and the valve element with a complementally shaped conical stop bore merging into the flow bore of the valve seat body.

3. A valve as defined by claim 1, further wherein the armature is provided with a narrow cylindrical guide section that offstands radially so as to fit snuggly into the flow bore while centering the armature and valve element radially in the flow bore.

4. A valve as defined by claim 3, further wherein the armature is provided with a tang which protrudes into a securing bore provided in the valve element and the tang is welded to the valve element.

5. A valve as defined by claim 1, further wherein an ejection opening of increasing diameter is provided in the valve seat body downstream of the valve seat, said ejection opening forming an annular gap at least partially via said sealing element.

6. A valve as defined by claim 1, further wherein the core and the armature are provided with complemental facing spherical surfaces.

7. A valve as defined by claim 6, further wherein the spherical surface on the core facing the armature is concave and the spherical surface on the armature facing the core is convex.

8. A valve as defined by claim 1, further wherein the armature abuts a deformable stop means when the valve opens, that deformable stop means allowing for adjustment of a partial valve stroke relative to the valve seat.

9. A valve as defined by claim 1, further wherein the armature and valve element are axially movable relative to one another for adjusting the partial valve stroke relative to the valve seat.

* * * * *